United States Patent [19]

Van Eeghem et al.

[11] 3,997,338

[45] Dec. 14, 1976

[54] GRAY CAST IRON

[75] Inventors: Jan Van Eeghem, Deurle; Charles Defrancq, Zele, both of Belgium

[73] Assignee: Centre de Recherches Scientifiques et Techniques de l'Industrie des Fabrications Metalliques, en abrege C.R.I.F., Brussels, Belgium

[22] Filed: Mar. 20, 1975

[21] Appl. No.: 560,242

[30] Foreign Application Priority Data

Mar. 22, 1974 Belgium ..... 812706

[52] U.S. Cl. ..... 75/124; 75/123 CB; 75/123 E; 75/130 R

[51] Int. Cl.[2] ..... C22C 38/06

[58] Field of Search ..... 75/123 CB, 123 E, 124, 75/130 R; 148/30

[56] References Cited

UNITED STATES PATENTS

| | | | |
|---|---|---|---|
| 2,622,022 | 12/1952 | Crome | 75/123 CB X |
| 2,750,284 | 6/1956 | Ihrig | 75/123 CB X |
| 3,295,963 | 1/1967 | Galvin | 75/123 E X |
| 3,392,013 | 7/1968 | Oldfield | 75/128 R X |
| 3,492,118 | 1/1970 | Mickelson | 75/130 R |
| 3,726,670 | 4/1973 | Kusaka | 75/123 CB X |
| 3,798,027 | 3/1974 | DeFranco et al. | 75/130 R X |

FOREIGN PATENTS OR APPLICATIONS

| | | | |
|---|---|---|---|
| 710,679 | 8/1968 | Belgium | 75/123 CB |

OTHER PUBLICATIONS

BCIRA Journal of Research 1961, Dawson, vol. 9, pp. 203–208.

Structure and Properties of Alloys, Brick, 1965, McGraw–Hill Book Company, pp. 364–369.

*Primary Examiner*—Arthur J. Steiner

*Attorney, Agent, or Firm*—Browdy and Neimark

[57] ABSTRACT

A gray cast iron is inoculated with 0.3 to 2% inoculating alloy, said inoculating alloy containing from 20 to 70% rare earths.

18 Claims, No Drawings

GRAY CAST IRON

This invention relates to a gray cast iron with lamellar (flake) graphite, high mechanical strength and low ledeburitic hardening, which comprises:

| | | |
|---|---|---|
| 2 | to | 4% C |
| 0 | to | 1% Si |
| 1 | to | 3% Al |
| 0 | to | 0.7% Mn |
| 0 | to | 0.05% S |
| 0 | to | 0.1% P |

and inoculated with 0.3 to 2% inoculating alloy.

A cast iron of such type has been disclosed in U.S. Pat. No. 3,798,027 in the name of the present applicants.

According to said previous patent, the inoculating alloy comprises as active inoculating element, an element chosen in the group comprised of Ca, Ba, Sr.

A first drawback of calcium alloys lies in such alloys causing the formation of a large amount of reaction slag. Said slag remains in suspension in the liquid iron and due to the density difference rises slowly to the bath surface. It is consequently required to slag-off the bath before the casting but even after such slagging, slag forms again on the surface. It is impossible to wait long enough to slag-off completely the cast iron, as such iron cools too much in the ladle. There results therefrom that some slag is always taken along inside the mold during the casting operation. To avoid slag entering the part, slag traps have to be provided inside the casting channel, which makes the casting system intricate.

A second drawback of the calcium alloys lies in the usual industrial alloys having too much silicon. Now the cast iron to which pertains this invention, which has for features a high mechanical strength and a low hardness, should have after inoculation, a silicon content lower than 1% and preferably than 0.75%.

This silicon limitation causes problems by the industrial manufacture where there should be reckoned with the accumulation of the silicon content in the batches due to the use of returns.

Indeed, assuming that the scrap contains $a$% of silicon and the inoculating medium $x$% of silicon, when inoculating with 1% of the alloy, the silicon content for the first melting will be:

$$a + \frac{x}{100}$$

When using r% of returns, the second batch will be comprised of: $(100 - r)$ scrap and $r$ returns.

The silicon amount in the second melting is:

$$a\left(\frac{100-r}{100}\right) + \frac{r}{100}\left(a + \frac{x}{100}\right) + \frac{x}{100} = a + \left(1 + \frac{r}{100}\right)\frac{x}{100}$$

By going further along these lines, one finds for the $n^{th}$ melting a silicon content equal to:

$$a + \left(1 + \frac{r}{100} + \frac{r^2}{100} + \cdots \frac{r^{n-1}}{100}\right)\frac{x}{100}$$

When going to the infinite, the relation tends towards:

$$a + \frac{100}{100 - r} \cdot \frac{x}{100} \qquad (1)$$

By taking $r = 40\%$ $a = 0.3\%$ (normal Si content in steel scrap)

$x = 66\%$ (in the case of SiCa which is the usual inoculating alloy in the industry), it is found that the limit silicon content will be equal to 1.40%.

The use of SiCa is thus substantially excluded for the industrial production of aluminum cast iron. From formula (1) there is derived that the limit silicon content in the cast iron will remain lower than 0.75% if the silicon content in the inoculating medium is not higher than 27%. Now there is no industrial alloy that contains enough calcium with a silicon content lower than 27%.

For the industrial production of aluminum cast irons, there has been produced a special alloy with the following composition: 30% Fe, 15% Ca, 25% Si, 30% Al.

As this alloy is not produced in large amounts, the manufacturing cost is very high, about 60 Belgian francs per pound.

In the previous patent in the name of the present applicants, mentioned hereinabove there has been disclosed an inoculating alloy the composition of which (FeAlCa) is free from Si; it is, however, an alloy obtained in the laboratory, the industrial production of which cannot be considered due to the prohibitive cost of removing Si.

The present invention has for an object to obviate the drawbacks due to the inoculating alloys disclosed in the above-mentioned patent in the name of the present applicants, by providing another type of inoculating alloys which allow to make the casting easier and to reduce the cost of manufacturing the alloy. For this purpose, according to the present invention, the inoculating alloy contains as active inoculating element from 5 to 75% rare earths.

In a preferred embodiment of the present invention, the inoculating alloy contains from 20 to 70% rare earths.

The active inoculating medium is comprised of one or more generally several rare earths (RE) as the man of the art knows. Usually the active inoculating medium is comprised of an alloy which is well known under the name of misch metal, which contains about 50% cerium and about 50% other rare earths such as lanthanum, neodymium and praseodymium.

It is significant, to demonstrate the importance of this invention, to mention, as disclosed in an article by Dawson in BCIRA Journal of Research 1961, vol. 9, pp. 207–208, FIG. 7, that an addition of more than 0.1 % misch metal to silicon cast iron, which corresponds to the addition of 0.05% cerium in the cast iron, results in obtaining, instead of gray iron, a complete white hardening of the cast iron. It will be clear from the following examples of the invention, and particularly from example 5, that in the case of the aluminum cast iron to which this invention pertains, an increasing addition up to 1.5% misch metal, which corresponds to an addition of 0.56% cerium in the cast iron, results in reducing the hardening depth.

Other details and features of the invention present will stand out from the following non-limitative examples of gray aluminum cast iron which have been inoculated according to the present invention.

Each example comprises a table of the iron characteristics according to the percentage of inoculating alloy. By way of comparison, the characteristics have been given for the same cast iron which has however been inoculated with 1% SiCa, the Ca content being 33%. By way of additional comparison, in column 6 (Si iron HB) has been given the normal Brinell hardness (HB) of a gray silicon cast iron the tensile strength of which corresponds to the tensile strength of the cast iron according to the present invention, as shown in column 4. The Brinell hardness given in column 6 has been computed according to the usual formula:

$$HB = 100 + 4.3\delta$$

$\delta$ being the tensile strength.

EXAMPLE 1

Composition of the cast iron

| Composition of the cast iron | | | | | |
|---|---|---|---|---|---|
| C | Si[x] | Mn | P | S | Al |
| 3.74 | 0.15 | 0.53 | 0.018 | 0.045 | 2.35 |

[x]silicon as determined before inoculating

[x] silicon as determined before inoculating

Inoculating with an alloy of the type FeSi (RE) comprised of:

- RE: Misch metal: 22%
- Silicon: 40%
- Remainder: iron

TABLE 1

| % inoculating medium added (1) | % Misch Metal added (2) | Hardening depth mm (3) | tensile strength kgf/mm2 ($\phi$ 30 mm) (4) | HB 10/3000/15 kgf/mm2 ($\phi$ 30 mm) (5) | Si iron HB (6) | % Si added with inoculant alloy (7) |
|---|---|---|---|---|---|---|
| 0.3 | 0.066 | 1.5 | 30.2 | 177 | 230 | 0.12 |
| 0.4 | 0.088 | 0.5 | 31.6 | 178 | 236 | 0.16 |
| 0.5 | 0.11 | 0 | 30.5 | 178 | 236 | 0.2 |
| 1% SiCa | | 1 | 30.5 | 174 | 231 | 0.66 |

EXAMPLE 2

Composition of the cast iron

| Composition of the cast iron | | | | | |
|---|---|---|---|---|---|
| C | Si[x] | Mn | P | S | Al |
| 2.92 | 0.21 | 0.55 | 0.020 | 0.050 | 2.58 |

[x]Silicon as determined before inoculating

[x]Silicon as determined before inoculating

Inoculation with an alloy of the type FeSi (RE) comprised of: - RE: Misch metal: 22%

- Silicon: 40%
- Remainder: iron

TABLE 2

| % inoculating medium added (1) | % Misch Metal added (2) | Hardening depth mm (3) | tensile strength kgf/mm2 ($\phi$ 30 mm) (4) | HB 10/3000/15 kgf/mm2 ($\phi$ 30 mm) (5) | Si iron HB (6) | % Si added with inoculant alloy (7) |
|---|---|---|---|---|---|---|
| 0.3 | 0.066 | 7.5 | 42.1 | 242 | 282 | 0.12 |
| 0.4 | 0.088 | 6.5 | 42.5 | 241 | 283 | 0.16 |
| 0.6 | 0.13 | 1.5 | 44.6 | 239 | 292 | 0.24 |
| 0.8 | 0.17 | 0.5 | 47 | 235 | 302 | 0.32 |
| 1% SiCa | | 4 | 46.8 | 236 | 301 | 0.66 |

EXAMPLE 3

Composition of the cast iron

| Composition of the cast iron | | | | | |
|---|---|---|---|---|---|
| C | Si[x] | Mn | P | S | Al |
| 2.94 | 0.26 | 0.55 | 0.016 | 0.072 | 2.38 |

[x]Silicon as determined before inoculating

[x]Silicon as determined before inoculating

Inoculating with an alloy of the type Si (RE) comprised of:

- RE: Misch metal: 66%
- Silicon: 33%

TABLE 3

| % inoculating medium added (1) | % Misch Metal added (2) | Hardening depth mm (3) | tensile strength kgf/mm2 (ϕ 30 mm) (4) | HB 10/3000/15 kgf/mm2 (ϕ 30 mm) (5) | Si iron HB (6) | % Si added with inoculant alloy (7) |
|---|---|---|---|---|---|---|
| 0.3 | 0.20 | 10.5 | 47.5 | 265 | 304 | 0.099 |
| 0.4 | 0.26 | 6 | 49.2 | 268 | 311 | 0.13 |
| 0.6 | 0.40 | 0 | 52.1 | 268 | 325 | 0.20 |
| 1% SiCa | | 4 | 47.8 | 256 | 305 | 0.66 |

EXAMPLE 4

Composition of the cast iron

| Composition of the cast iron | | | | | |
|---|---|---|---|---|---|
| C | Si* | Mn | P | S | Al |
| 3.13 | 0.15 | 0.57 | 0.025 | 0.044 | 2.08 |

*Silicon as determined before inoculating

*Silicon as determined before inoculating

Inoculating with an alloy of the type FeSi (RE) comprised of:

- RE: Misch metal: 5%
- Silicon: 40%
- Remainder: iron

TABLE 4

| % inoculating medium added (1) | % Misch Metal added (2) | Hardening depth mm (3) | tensile strength kgf/mm2 (ϕ 30 mm) (4) | HB 10/3000/15 kgf/mm2 (ϕ 30 mm) (5) | Si iron HB (6) | % Si added with inoculant alloy (7) |
|---|---|---|---|---|---|---|
| 0.3 | 0.015 | 10.5 | 35.1 | 247 | 252 | 0.12 |
| 0.6 | 0.03 | 6.5 | 36.2 | 245 | 256 | 0.24 |
| 1 | 0.05 | 1.5 | 37.6 | 246 | 262 | 0.4 |
| 1.5 | 0.075 | 0 | 42.3 | 242 | 282 | 0.6 |
| 1% SiCa | | 2 | 43.2 | 246 | 286 | 0.66 |

EXAMPLE 5

Composition of the cast iron

| Composition of the cast iron | | | | | |
|---|---|---|---|---|---|
| C | Si* | Mn | P | S | Al |
| 3.37 | 0.13 | 0.60 | 0.028 | 0.054 | 2.65 |

*Silicon as determined before inoculating

*Silicon as determined before inoculating

Inoculating with an alloy of the type FeSi(RE) comprised of:

- RE: Misch metal: 75%
- Silicon: 12.5%
- Remainder: iron

TABLE 5

| % inoculating medium added (1) | % Misch Metal added (2) | Hardening depth mm (3) | tensile strength kgf/mm2 (ϕ 30 mm) (4) | HB 10/3000/15 kgf/mm2 (ϕ 30 mm) (5) | Si iron HB (6) | % Si added with inoculant alloy (7) |
|---|---|---|---|---|---|---|
| 0.3 | 0.225 | 15 | 35.9 | 229 | 254 | 0.037 |
| 0.8 | 0.6 | 7 | 42.7 | 249 | 284 | 0.1 |
| 1.2 | 0.9 | 4 | 42.5 | 232 | 283 | 0.15 |
| 1.5 | 1.125 | 2 | 45.1 | 242 | 94 | 0.187 |
| 1% SiCa | | 2 | 47 | 248 | 302 | 0.66 |

EXAMPLE 6

Composition of the cast iron

| Composition of the cast iron | | | | | |
|---|---|---|---|---|---|
| C | Si* | Mn | P | S | Al |
| 3.32 | 0.13 | 0.57 | 0.026 | 0.071 | 2.25 |

*Silicon as determined before inoculating

*Silicon as determined before inoculating

Inoculating with an alloy of the type FeSi(RE)Ca comprised of:

- Re: Misch metal: 25%
- Calcium: 10%
- Silicon: 40%
- Remainder: iron

TABLE 6

| % inoculating medium added (1) | % Misch Metal added (2) | Hardening depth mm (3) | tensile strength kgf/mm2 (ϕ 30 mm) (4) | HB 10/3000/15 kgf/mm2 (ϕ 30 mm) (5) | Si iron HB (6) | % Si added with inoculant alloy (7) |
|---|---|---|---|---|---|---|
| 0.3 | 0.075 | 14 | 34.9 | 245 | 250 | 0.12 |
| 0.6 | 0.15 | 10 | 34.8 | 235 | 250 | 0.24 |
| 1 | 0.25 | 3 | 38.1 | 246 | 264 | 0.4 |
| 1.5 | 0.37 | 1 | 41.6 | 241 | 279 | 0.6 |
| 1% SiCa | | 3 | 39.4 | 236 | 270 | 0.66 |

EXAMPLE 7

Composition of the cast iron

| Composition of the cast iron | | | | | |
|---|---|---|---|---|---|
| C | Si | Mn | P | S | Al[r] |
| 3.13 | 0.16 | 0.58 | 0.027 | 0.047 | 2.44 |

[r]Aluminum as determined before inoculating

[r]Aluminum as determined before inoculating

Inoculating with an alloy of the type FeAl (RE) comprised of:

- RE: Misch metal: 50%
- Aluminum: 25%
- Iron: 25%

TABLE 7

| % inoculating medium added (1) | % Misch Metal added (2) | Hardening depth mm (3) | tensile strength kgf/mm2 (ϕ 30 mm) (4) | HB 10/3000/15 kgf/mm2 (ϕ 30 mm) (5) | Si iron HB (6) | % Si added with inoculant alloy (7) |
|---|---|---|---|---|---|---|
| 0.3 | 0.15 | 6 | 42.3 | 246 | 282 | — |
| 0.6 | 0.3 | 2 | 44.9 | 245 | 293 | — |
| 1 | 0.5 | 1 | 45.6 | 243 | 296 | — |
| 1% SiCa | | 2 | 43.2 | 246 | 286 | 0,66 |

The examples show that it is desirable to use an inoculating alloy the active element of which comprises between about 20% (22% in the examples) and about 70% (66% in the examples) by weight of the alloy.

It is then possible to use but from 0.3 to 0.8% by weight of inoculating alloy to obtain very satisfying characteristics in the cast iron, as regards the three conditions under consideration: low ledeburitic hardening, high tensile strength, not too high a hardness.

The tables also show (columns 5 and 6) that the aluminum cast irons inoculated with an alloy based on rare earths are substantially less hard, for the same strength, than the conventional silicon cast iron.

It must be understood that the invention is in no way limited to the above examples and that many changes can be brought therein without departing from the scope of the invention as defined by the appended claims.

For instance other inoculating alloys such as Al (RE); Cu (RE); CuSi (RE); Ni (RE); NiSi (RE) can be used.

We claim:

1. A high strength, low hardness, gray cast iron having a flake graphite structure having a composition consisting essentially of about 1-3% aluminum, 2-4% carbon, up to 1% silicon, up to 0.7% manganese, up to 0.05% sulfur, up to 0.1% phosphorus and the balance iron, said gray iron having been inoculated with 0.3 to 2% of inoculant alloy, comprising rare earths as active inoculant component in a percentage which corresponds to the addition of 0.015 to 1.5% of rare earths to said composition.

2. An iron according to claim 1, wherein said active inoculant component being present in the alloy in an amount effective to reduce the Brinell hardness of the as cast alloy by about 50 Brinell units in relation to normal silicon containing iron having the same strength.

3. An iron according to claim 1 wherein the percentage of active inoculant corresponds to the addition of 0.06 to 1.4% of rare earth to said composition.

4. An iron according to claim 3, wherein the percentage of active inoculant corresponds to the addition of 0.066 to 1.32% of rare earth to said composition.

5. An iron according to claim 1, wherein the inoculant alloy is comprised of misch metal.

6. An iron according to claim 2, wherein the inoculant alloy is comprised of misch metal.

7. An iron according to claim 1, having been inoculated with 0.3 to 0.8% of the inoculant alloy wherein the percentage of rare earths corresponds to the addition of 0.015 to 0.6% of rare earths to said composition.

8. An iron according to claim 1, wherein the inoculant alloy comprises a further active inoculant component selected from the group consisting of calcium, barium and strontium.

9. An iron according to claim 2, wherein the inoculant alloy comprises a further active inoculant component selected from the group consisting of calcium, barium and strontium.

10. A high strength, low hardness, gray cast iron having a flake graphite structure having a composition consisting essentially of about 1–3% aluminium, 2–4% carbon, up to 1% silicon, up to 0.7% manganese, up to 0.05% sulfur, up to 0.1% phosphorus and the balance iron, said gray iron having been inoculated with an inoculant alloy comprising rare earths as active inoculant component, in a percentage which corresponds to addition of 0.11 to 1.5% of rare earth to the composition.

11. An iron according to claim 10, wherein said active inoculant component being present in the alloy in an amount effective to reduce the Brinell hardness of the as cast alloy by about 50 Brinell units in relation to normal silicon containing iron having the same strength.

12. An iron according to claim 10, wherein the percentage of active inoculant corresponds to addition of 0.11 to 1.4% of rare earth to said composition.

13. An iron according to claim 12, wherein the percentage of active inoculant corresponds to addition of 0.11 to 1.32% of rare earth to said composition.

14. An iron according to claim 10, wherein the inoculant alloy is comprised of misch metal.

15. An iron according to claim 11, wherein the inoculant alloy is comprised of misch metal.

16. An iron according to claim 10, wherein the percentage of active inoculant corresponds to addition of 0.11 to 0.6% of rare earth to said composition.

17. An iron according to claim 10, wherein the inoculant alloy comprises a further active inoculant component selected from the group consisting of calcium, barium and strontium.

18. An iron according to claim 11, wherein the inoculant alloy comprises a further active inoculant component selected from the group consisting of calcium, barium and strontium.

* * * * *